US005559892A

United States Patent [19]

Boor

[11] Patent Number: 5,559,892

[45] Date of Patent: Sep. 24, 1996

[54] IMPEDENCE BUFFERING MOS CIRCUIT WITH DYNAMICALLY REDUCED THRESHOLD VOLTAGE, AS FOR USE IN AN OUTPUT BUFFER OF A HEARING AID AMPLIFIER

[75] Inventor: Steven E. Boor, Lombard, Ill.

[73] Assignee: Knowles Electronics, Inc., Itasca, Ill.

[21] Appl. No.: 218,603

[22] Filed: Mar. 28, 1994

[51] Int. Cl.[6] ..... H04R 25/00; H03F 3/16

[52] U.S. Cl. ..... 381/68.4; 381/68.2; 327/312; 327/379; 327/434; 327/437; 330/277; 330/307

[58] Field of Search ..... 381/68.4, 68, 68.2, 381/69.2; 73/585; 128/746; 330/307, 277, 269, 264; 307/98, 412; 327/434, 436, 437, 108, 312, 316, 319, 379

[56] References Cited

U.S. PATENT DOCUMENTS

| | | | |
|---|---|---|---|
| 3,823,332 | 7/1974 | Feryszka et al. | 307/297 |
| 4,495,384 | 1/1985 | Scott et al. | 179/107 FD |
| 4,509,193 | 4/1985 | Carlson | 381/68 |
| 4,539,441 | 9/1985 | Eggert et al. | 381/69.2 |
| 5,097,515 | 3/1992 | Baba | 381/168 |
| 5,105,102 | 4/1994 | Shioda | 307/443 |
| 5,194,831 | 3/1993 | Jackson | 307/497 |
| 5,208,867 | 5/1993 | Stites, III | 381/169 |

FOREIGN PATENT DOCUMENTS 2105147 3/1983 United Kingdom .

OTHER PUBLICATIONS

RCA COS/MOS Integrated Circuit Manual, 1971 RCA Corp. pp. 134–137.

*Primary Examiner*—Curtis Kuntz
*Assistant Examiner*—Xu Mei
*Attorney, Agent, or Firm*—Wallenstein & Wagner, Ltd.

[57] ABSTRACT

A buffer circuit, such as for use with a low voltage hearing aid, is disclosed. The hearing aid comprises a microphone, a receiver and an amplifier. The amplifier is disposed between the microphone and the receiver. The buffer circuit has a MOS device including a well terminal and a gate terminal equipotentially coupled together to reduce the effective threshold voltage of the MOS device, thereby reducing the gate-to-source voltage of the MOS device. This permits a greater linear output signal range for the amplifier.

5 Claims, 2 Drawing Sheets

IMPEDENCE BUFFERING MOS CIRCUIT WITH DYNAMICALLY REDUCED THRESHOLD VOLTAGE, AS FOR USE IN AN OUTPUT BUFFER OF A HEARING AID AMPLIFIER

TECHNICAL FIELD

The present invention relates to a circuit for dynamically adjusting the threshold voltage of a MOS device, as for use in an output buffer of a hearing aid amplifier.

BACKGROUND PRIOR ART

In certain signal processing applications, such as an amplifier, a buffer circuit is required to reduce the output impedance of the amplifier to more closely match the input impedance of the device to which the amplifier is connected.

For example in a hearing aid, an amplifier is coupled between a microphone and a receiver. The microphone receives sound energy and converts the received sound energy to a corresponding electrical signal. The amplifier then amplifies the received electrical signal and the receiver converts the amplified electrical signal to amplified sound energy. In many such systems, the amplifier has a relatively high output impedance, and an output buffer is utilized to match the input impedance of the receiver. In fact, the closed loop gain of the amplifier is proportional to the output impedance of the amplifier. Thus the greater the closed loop gain of the amplifier, the greater the likely mismatch between the output impedance of the amplifier and the input impedance of the receiver.

In many circuits, conventional buffer circuits are satisfactory. However, many circuits operate at extremely low voltages. For example, circuits such as for hearings aids are designed for operation with a 1.1 volt battery. Thus $V_{GS}$ for the CMOS device in the buffer effectively limits the linear output range of the amplifier.

For CMOS devices, the surface potential in the channel can be modulated by either the gate or well potential. Normal operation usually biases the well (or bulk) at the same potential as the source (i.e., $V_{SB}=0$), or the well to source junction is maintained in reverse bias. Maintaining zero or reverse bias from the source to well ensures that no carriers are injected laterally across the IC, which is a mechanism which leads to latch-up in CMOS circuits.

However, if the source to well (or bulk) potential, $V_{SB}$, is forward biased and any laterally injected carriers are collected by heavily doped guard rings around the well, then latch-up is inhibited. This is especially true if the lateral current density is kept low, such as for small forward bias voltages for $V_{SB}$ (i.e., <<0.5 v). The well could then be used directly to modulate the surface potential in the channel region of an MOS device in a useful and enhanced manner.

When the well is tied directly to the gate and the MOS device is operated in weak inversion (sub-threshold), the ideality factor in the exponential I-V relation becomes nearly unity (as in the case of a bipolar transistor) since the surface potential becomes modulated directly by the gate to source voltage, instead of by an "effective" gate to source voltage formed by a capacitive divider between $C_{ox}$ and $C_{depletion}$, wherein:

$$\text{"effective"}=V_{GS}\times C_{ox}/(C_{ox}+C_{depl}).$$

This will result in improved $g_m$ for MOS devices operated in weak inversion.

Thus an effective, or dynamic, lowering of the threshold voltage, $V_T$, for MOS transistors can be obtained in circuits by forward bias of the well to source junction. Enhanced transconductance equal to that of bipolar transistors can be expected if the well is tied to the gate and the MOS device is operated in weak inversion.

The present invention is provided to solve these and other problems.

SUMMARY OF THE INVENTION

It is an object of the present invention to provide a buffer circuit, such as for use with a hearing aid. The buffer circuit is adapted to be coupled between first and second electronic devices and substantially matches the output impedance of the first device with the input impedance of the second device.

In accordance with one aspect of the invention, the hearing aid comprises a microphone, a receiver and an amplifier. The amplifier is disposed between said microphone and said receiver. The buffer circuit has an MOS device including a well terminal and a gate terminal which are equipotentially coupled together. By coupling the well terminal to the gate terminal, the threshold voltage $V_T$ of the MOS device is reduced, thereby reducing the gate-to source voltage $V_{GS}$ of the MOS device.

The invention is especially applicable in low power supply voltage circuits, such as hearing aids which are designed to operate on battery supply voltages as low as 1.1 v.

Other features and advantages of the invention will be apparent from the following specification taken in conjunction with the following drawing.

DETAILED DESCRIPTION

Figure 1:
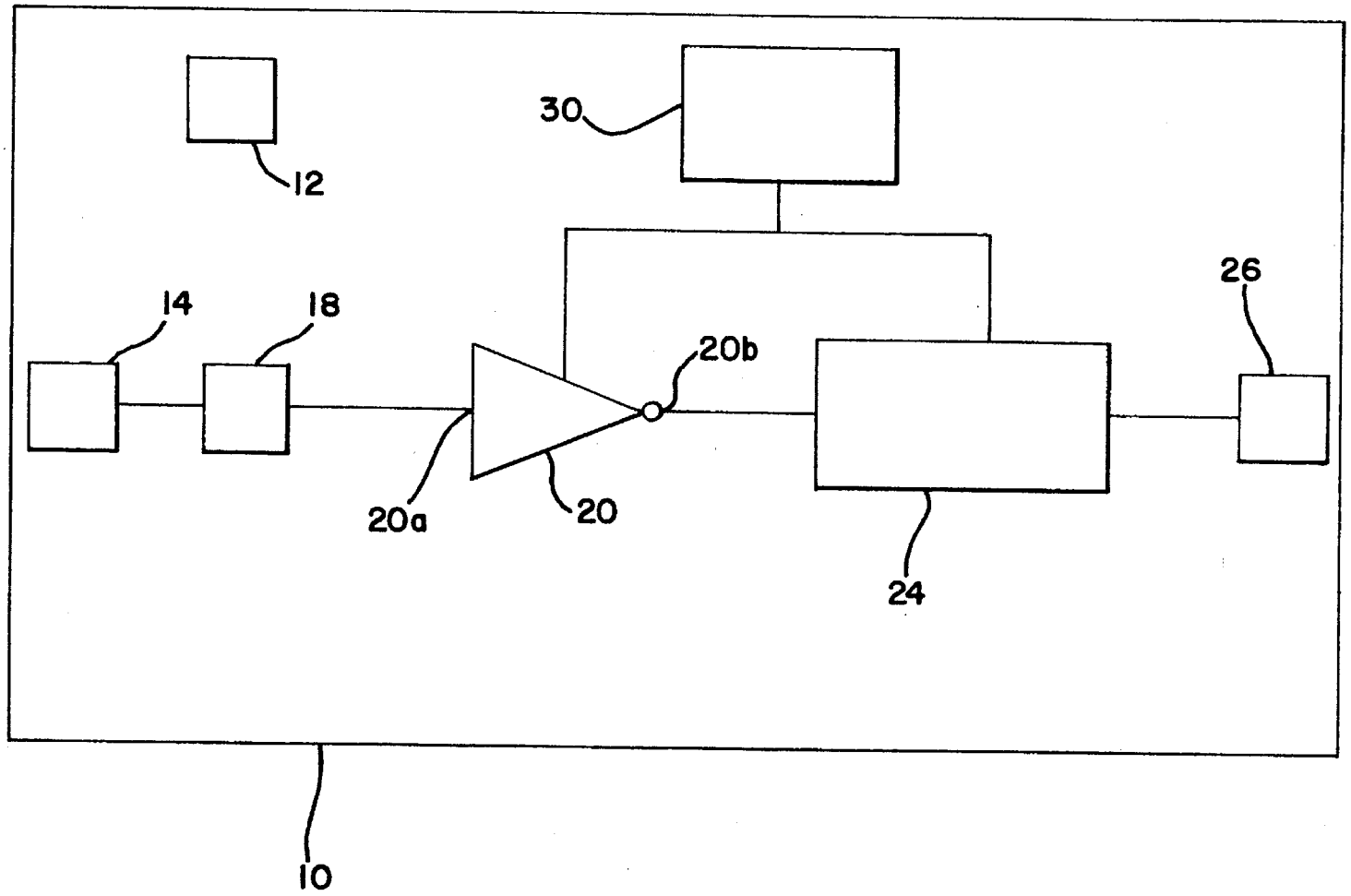
FIG. 1 is a block diagram illustrating a circuit for a hearing aid incorporating the present invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A device, generally designated 10, for converting received sound to a corresponding amplified signal, and subsequently converting the amplified signal to a corresponding amplified sound is illustrated in FIG. 1. The device 10 comprises a battery 12 and an electret microphone 14. The battery 12 functions as a low voltage power supply, providing a nominal 1.1 v. The electret microphone 14 is as utilized in the commercially available Model EZ microphone, sold by Knowles Electronics of Itasca, Ill. As is well known, the electret microphone includes a charged plate (not shown) which is coupled to the gate of an FET 18. Though not required for a complete understanding of this invention, a more detailed explanation is contained in co-pending U.S. Pat. Nos. 5,408,534 and 5,446,413.

As is also well known, the FET 18 has an input, herein the gate, and an output. The charged plate 14 is coupled to the gate of the FET.

The device further comprises an amplifier 20 having an input 20*a* and an output 20*b*. The amplifier input 20*a* is coupled to the output of the FET 18. The amplifier output 20*b* has an output impedance which is proportional to the closed loop gain of the amplifier 20.

The device further comprises a buffer, generally designated 24, which is coupled to the output 20*b* of the amplifier 20. The buffer has a buffer input impedance substantially equal to the output impedance of the amplifier 20 and a buffer output impedance substantially less than the amplifier output impedance.

The device also comprises a receiver 26 which converts the signal amplified by the amplifier 20 to an amplified sound, as is well known. The buffer 24 matches the relatively high output impedance of the amplifier 20 to relatively low input impedance of the receiver 26 to prevent gain attenuation. The device 10 also includes a constant current source, or reference, 30.

As discussed in greater detail below, the buffer 24 includes a MOS device and means for reducing the threshold voltage $V_T$ of the MOS device to reduce the gate-to-source voltage of the MOS device. This minimizes the voltage drop across the buffer 24, permitting use of greater signal amplitudes from the amplifier 20 at the low voltage provided by the battery 12.

Figure 2:
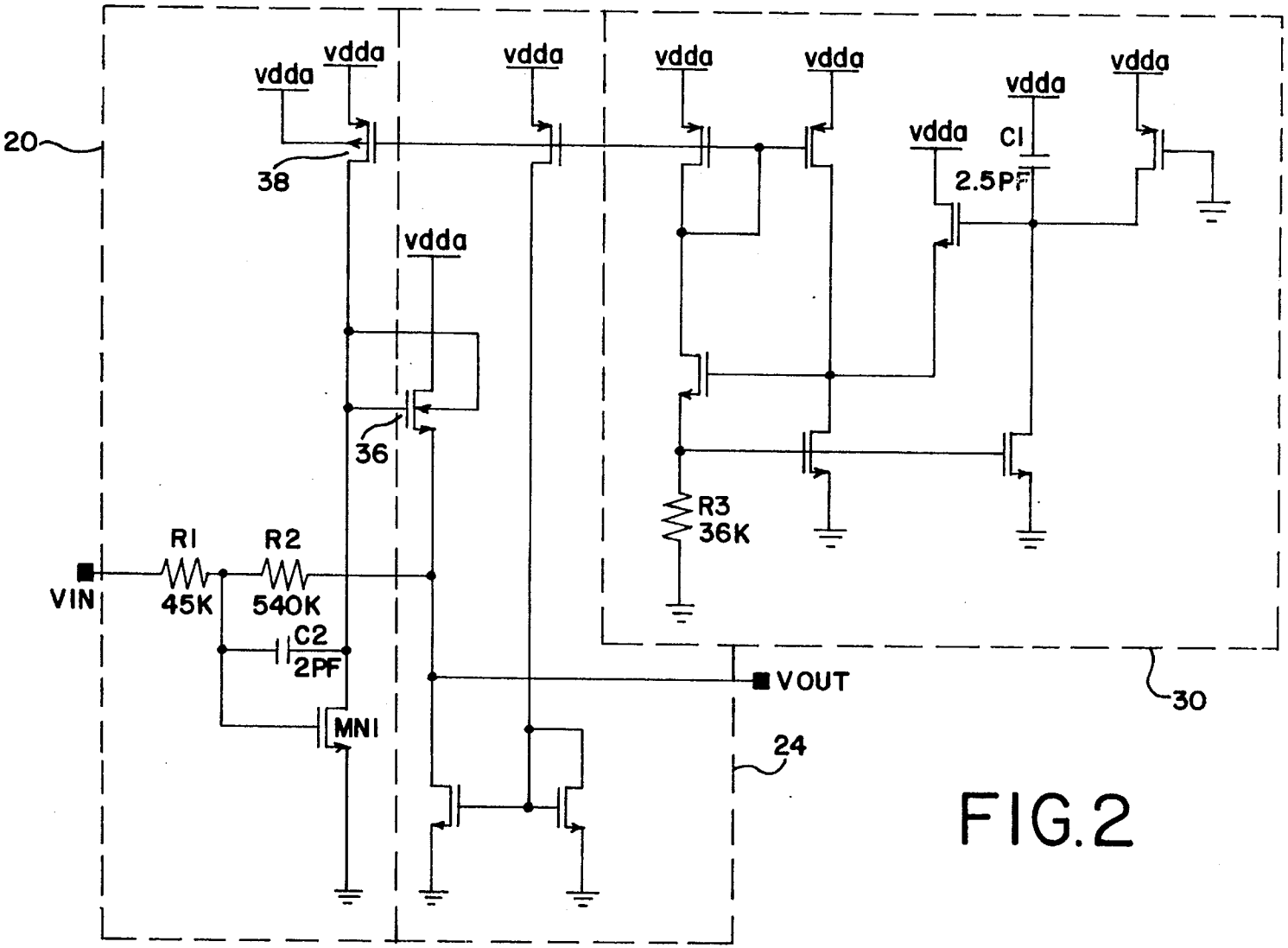
FIG. 2 is a schematic circuit of a portion of the hearing aid circuit illustrating the present invention in greater detail.

The amplifier 20, buffer 24 and current reference 30 are illustrated in greater detail in FIG. 2.

The signal from the FET 18 (FIG. 1) is coupled to the amplifier at terminal $V_{IN}$, and the amplifier 20 has a gain K of $-R_2/R_1$. As noted above, the output impedance of the amplifier 20 is proportional to the amplifier 20. In the present illustration, the gain K is twelve and the output impedance is 100 kΩ.

Terminal $V_{OUT}$ is coupled to the receiver 26. The term "receiver" is used herein, but could also include such other devices which potentially could be coupled thereto, such as additional amplifiers or other signal processing devices having relatively low input impedances.

The voltage at $V_{OUT}$ has a dc level of 0.4 v, due to the required $V_{GS}$ of device MN1. When using conventional gate, source, drain and bulk connections, i.e., with the bulk tied to the source, an n-channel MOS device has a nominal threshold voltage of 0.5 v, which corresponds to a gate-to-source voltage of 0.4 v, when operated in weak inversion. Assuming a design criterium of a battery voltage of 1.1 v, and assuming that all MOS devices require a source-to-drain voltage of 0.1 v for linear operation, then the linear output range of the amplifier 20 is limited to 0.4 v, peak-to-peak, for a sinusoidal input.

In accordance with the present invention, and referring in particular to the output buffer 24 portion thereof, it has been found that by placing the bulk terminal of the n-channel MOS device 36 at the same potential as the gate potential of the n-channel MOS device 36, the effective threshold voltage is reduced dynamically, and hence the gate-to-source voltage, of the n-channel MOS device 36 is lowered to 0.25 v. This reduction permits an increase in the linear output range of the amplifier from 0.4 v to 0.6 v for a sinusoidal input, an increase of 50%.

It was noted above that such n-channel devices have a nominal threshold voltage of approximately 0.5 v. However in practice this voltage varies device to device. Accordingly, circuits conventionally must have been designed to a certain extent to the worst possible case. It has been found that by dynamically reducing the effective threshold voltage as described above, the actual device to device variance is lessened.

It has also been found that by dynamically reducing the threshold voltage, the conductance $g_m$ of the n-channel device is increased by 33% above the conventional bulk connection methods, thereby further reducing the output impedance of the output buffer 24, typically to 300 Ω.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An impedence buffering circuit for permitting smooth signal flow from a first transmission medium to a second transmission medium comprising:

an input adapted for coupling to the first transmission medium for receiving a signal;

a MOS transistor coupled through the input to the first transmission medium for transforming the impedance imposed on the signal, the MOS transistor including a well terminal and a gate terminal both having an AC potential that is substantially equal to the input AC potential, such that the threshold voltage $V^T$ of the MOS transistor is reduced to reduce the gate-to-source voltage of the MOS transistor; and means for reducing the threshold voltage $V^T$ of the MOS transistor to reduce the gate-to-source voltage of the MOS transistor;

an output coupled to the MOS transistor and adapted for coupling to the second transmission medium for conveying the impedence-transformed signal to the second transmission medium.

2. The impedence buffering circuit of claim 1, wherein the first transmission medium is coupled to a hearing aid microphone, and the second transmission medium is coupled to a hearing aid receiver.

3. A device for converting sound to a corresponding amplified signal, the device comprising:

an electret microphone including a charged plate and an FET, the FET having an input and an output, said charged plate being coupled to said input of said FET;

an amplifier having an input and an output, said amplifier input being coupled to said output of said FET, said amplifier output having an output impedance;

buffer means coupled to said output of said amplifier, said buffer means having a buffer input impedance substantially equal to the output impedance of said amplifier and a buffer output impedance substantially less than said amplifier output impedance, said buffer means including a MOS device having a well terminal and a gate terminal both equipotentially coupled to the buffer input, such that the threshold voltage $V^T$ of the MOS device is reduced to reduce the gate-to-source voltage of the MOS device.

4. A device for converting sound to a corresponding amplified signal, the device comprising:

a low voltage power supply;

an electret microphone including a charged plate and an FET, the FET having an input and an output, said charged plate being coupled to said input of said FET;

an amplifier having an input and an output, said amplifier input being coupled to said output of said FET, said amplifier output having an output impedance; and, buffer means coupled to said output of said amplifier, said buffer means having a buffer input impedance substantially equal to the output impedance of said amplifier and a buffer output impedance substantially less than said amplifier output impedance, said buffer means including a MOS device having a well terminal and a gate terminal both having an AC potential that is substantially equal to the input AC potential, such that the threshold voltage $V^T$ of the MOS device is reduced to reduce the gate-to-source voltage of the MOS device.

5. The device of claim 4 wherein said low voltage power supply comprises a battery having a voltage of 1.5 v or less.

* * * * *